US009580231B2

(12) United States Patent
Sanguinet et al.

(10) Patent No.: US 9,580,231 B2
(45) Date of Patent: Feb. 28, 2017

(54) CONTAINER

(71) Applicant: Berlin Packaging, LLC, Chicago, IL (US)

(72) Inventors: Andrew Sanguinet, La Grange Park, IL (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 53 days.

(21) Appl. No.: 14/599,861

(22) Filed: Jan. 19, 2015

(65) Prior Publication Data

US 2016/0207668 A1 Jul. 21, 2016

(51) Int. Cl.

| | |
|---|---|
| ***B65D 43/18*** | (2006.01) |
| ***B65D 47/26*** | (2006.01) |
| ***B65D 83/04*** | (2006.01) |
| ***B65D 83/00*** | (2006.01) |
| ***A47G 19/24*** | (2006.01) |

(52) U.S. Cl.

CPC ..... *B65D 83/0481* (2013.01); *B65D 83/00* (2013.01); *B65D 83/04* (2013.01)

(58) Field of Classification Search

CPC ..... B65D 47/265; B65D 83/00; B65D 83/04; B65D 47/263; B65D 83/0481; A47G 19/24

USPC ..... 220/820, 821

See application file for complete search history.

(56) References Cited

U.S. PATENT DOCUMENTS 2,391,347 A * 12/1945 Punte ..... B65D 47/265 206/528

3,494,515 A * 2/1970 Fattori ..... B65D 11/02 222/548

* cited by examiner

*Primary Examiner* — Fenn Mathew
*Assistant Examiner* — Andrew T Kirsch
(74) *Attorney, Agent, or Firm* — Adam K. Sacharoff; Much Shelist

(57) ABSTRACT

There is provided a container having a bottom shell and a top cover configured for partial rotation with respect to each other. In its closed configuration the container maintains the items in an interior holding region, while in the open configuration the container exposes a section that opens to the interior holding region and which permits the items to be dispensed by the user.

14 Claims, 11 Drawing Sheets

CONTAINER

FIELD OF THE INVENTION

The present invention relates to a container used to dispense small items such as candy or mints.

BACKGROUND OF THE INVENTION

Many containers provided in the prior art are created to hold and dispense small items. Some of these have twist tops, which expose a small opening for the items to dispense. The particular invention builds upon the prior art to create a unique and novel twist opening.

SUMMARY OF THE INVENTION

In one embodiment of the present invention there is provided a container for holding a small item such as candy or mints. The container has a bottom shell and a top cover that rotates in relation to the bottom shell. The rotation is about forty five degrees and when the top cover is rotated a small opening appears that allows the dispensing of the small items contained therein.

In one embodiment there is provided a container defined to have a bottom shell and a top cover. The bottom shell includes a base with a surrounding bottom side wall to create an interior holding region therebetween. The bottom shell further has an inside interior surface edge positioned adjacent the bottom side wall, the interior surface edge having a gap positioned about at least one corner of the bottom shell. The container further includes an intermediate connector having a plate with an outer edge shaped to fit against the upstanding wall and against the interior surface edge. The plate is configured to cover the interior holding region, but has a portion of the outer edge configured to be smaller than the interior surface edge at the at least one corner of the bottom shell to define at least one exposed corner of the bottom shell and to provide access to the interior holding region. The intermediate connector further has an intermediate annular ring extend from the internal plate with retention stops and clips spaced around the exterior surface thereof. The top cover has a top interior surface with a surrounding top side wall extending downwardly such that when the top cover and bottom shell are assembled together the top side wall and bottom side wall fit together to seal contents within the container in a closed configuration. The top cover further has a top annular ring extending from the top interior surface and sized to receive there-within the intermediate annular ring. The top annular ring has interspaced stop flanges and elongated flanges positioned to coact with the retention stops and clips of the intermediate annular ring to connect the top cover to the intermediate connecter and further configured to permit rotation of the top cover with respect to the bottom shell such that the top cover when rotated to an open configuration the at least one exposed corner of the bottom shell is open to permit dispensing of contents within the interior holding region.

In other aspects the container also includes a plurality of ribs extending from an exterior surface of the top annular ring and positioned about the at least one corner of the bottom shell when assembled and in the closed configuration. The plurality of ribs are configured to screen over the at least one corner of the bottom shell to prevent contents from leaving the interior holding region when in the closed configuration.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
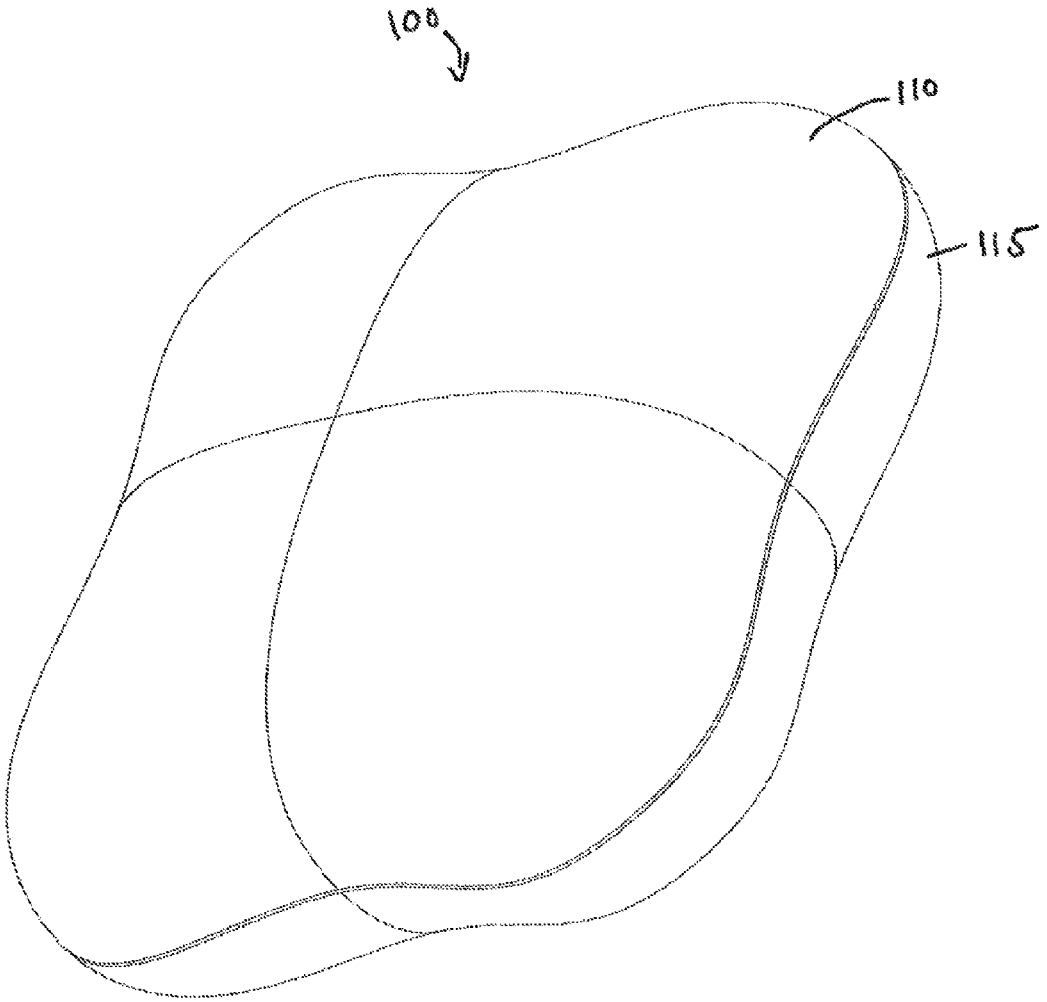
FIG. 1 is a perspective view of the container in the closed configuration.
Figure 2:
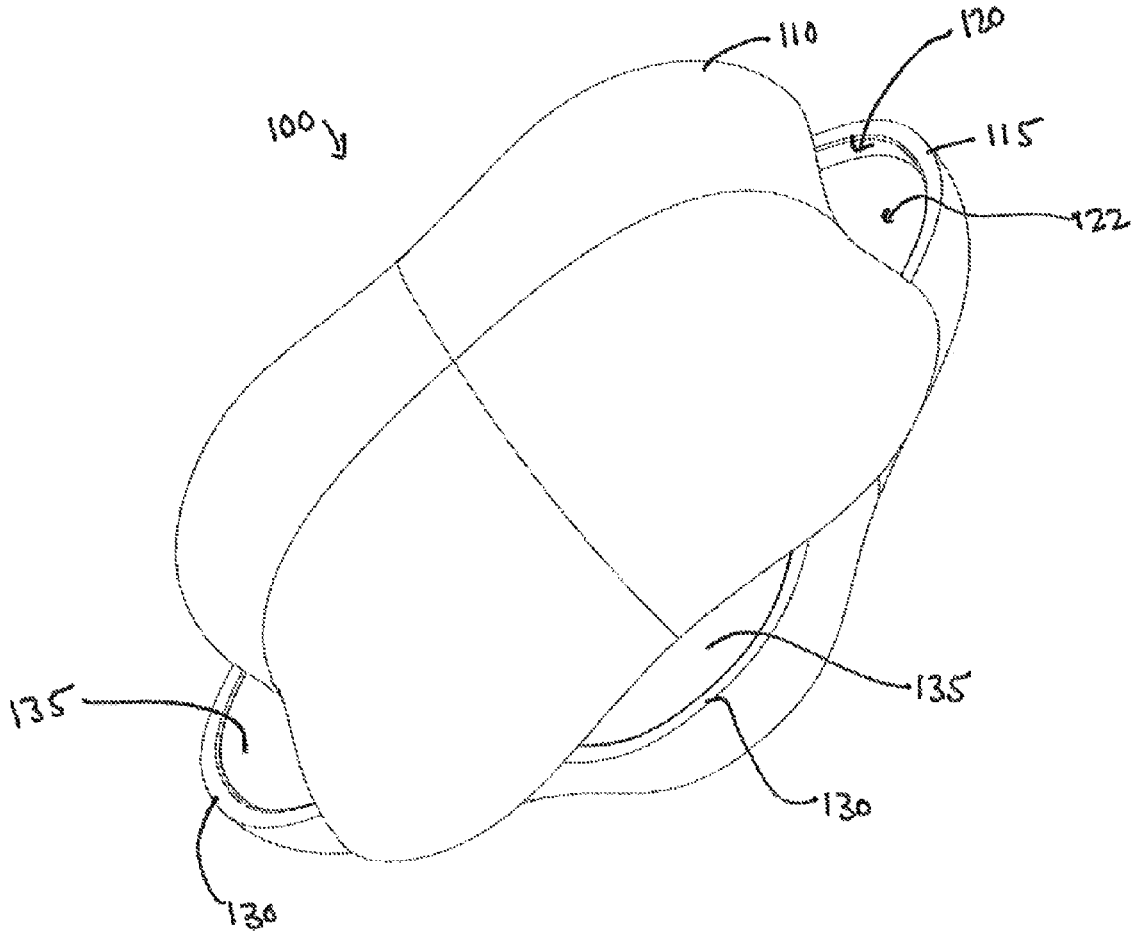
FIG. 2 is a perspective view of the container in the open configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIGS. 1 through 9B there is shown a container 100 used to hold and dispense small items, such as candy or mints. The container 100 is comprised of two halves: a bottom shell 105 and a top cover 110 that are capable of rotating with respect to each other. In its closed configuration (FIG. 1) the container 100 maintains the items in an interior holding region, while in the open configuration (FIG. 2) the container 100 exposes a section 115 that opens to the interior holding region and which permits the items to be dispensed by the user.

As illustrated, the rotation of the top cover 110 with respect to the bottom shell 105 is done by rotating the top cover 110 a predetermined distance. Since the shape of the container 100 is defined to substantially have at least one corner 120 in the bottom shell 105, which when the top cover 110 is rotated a predetermined distance, the rotation can be done such that the at least one corner 120 is exposed. As described herein, the at least one exposed corner 120 can channel 122 into the interior holding region 107 (defined in the bottom shell 105) such that the items contained therein can be dispensed. To prevent the items from dispensing out of other corners 130, an internal plate 135 can be installed to cover the other corners.

Figure 3:
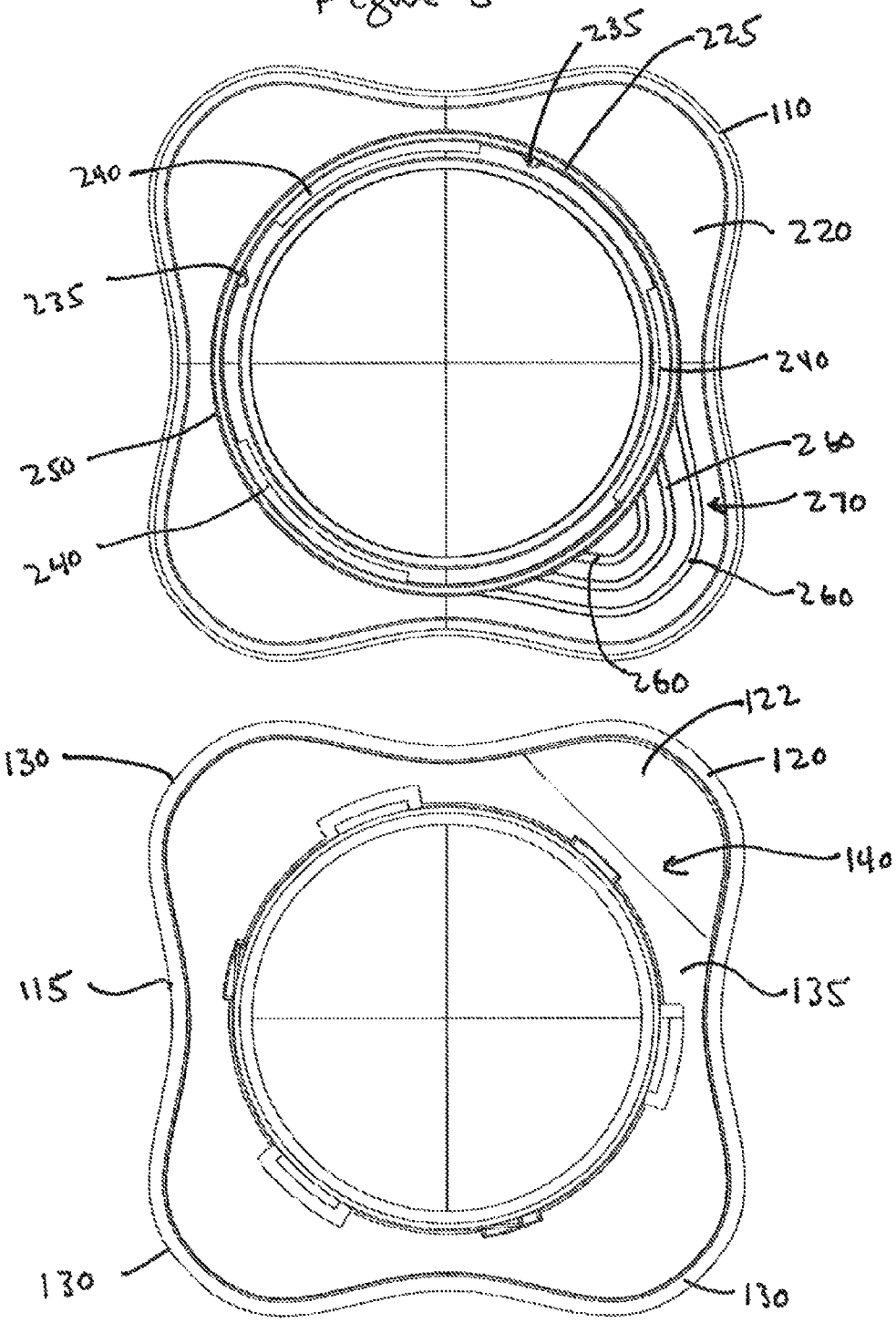
FIG. 3 is a top view of the container with the top cover exposed from the container and orientated in the closed configuration.
Figure 4:
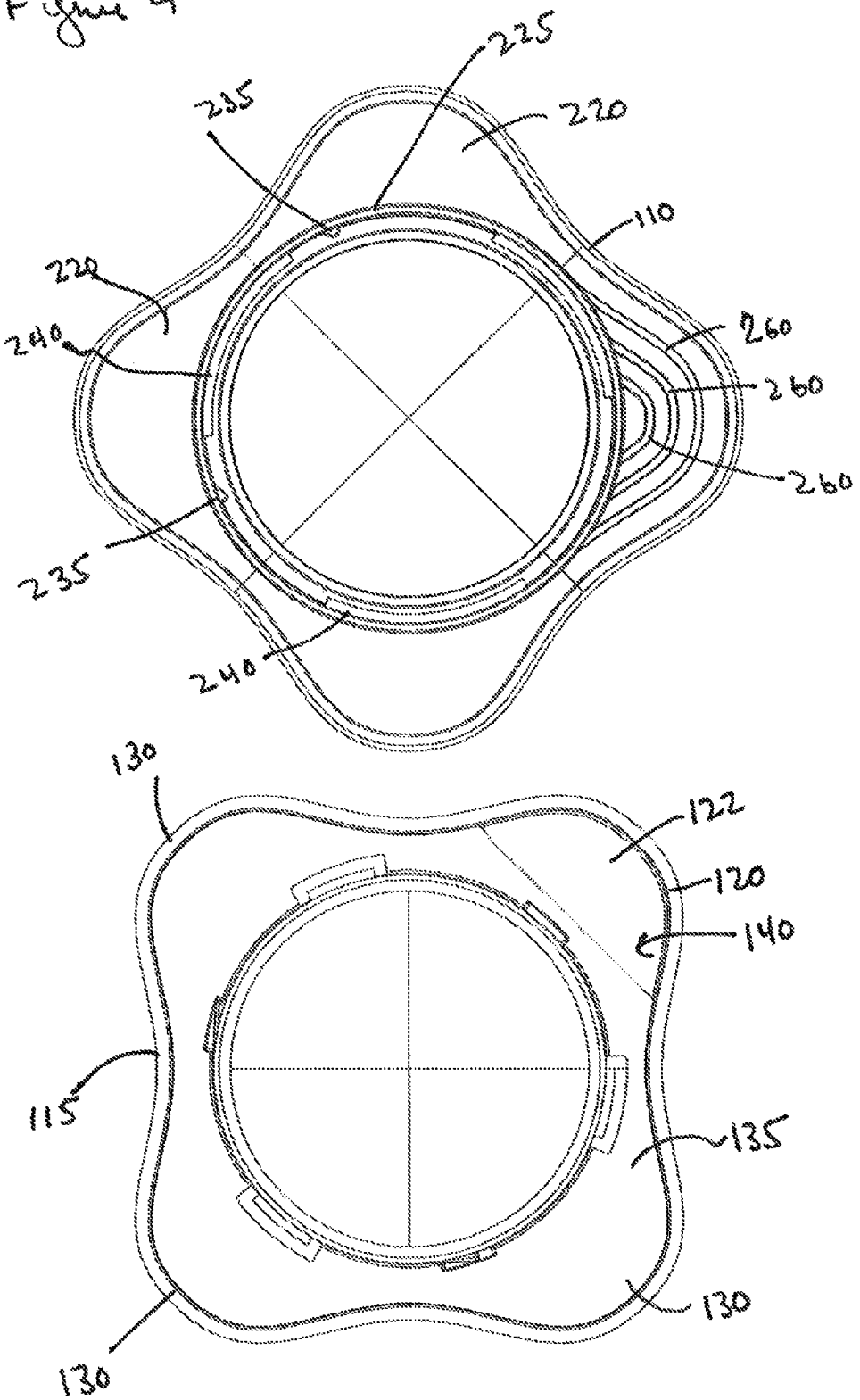
FIG. 4 is a top view of the container with the top cover exposed from the container and oriented in the open configuration.
Figure 5:
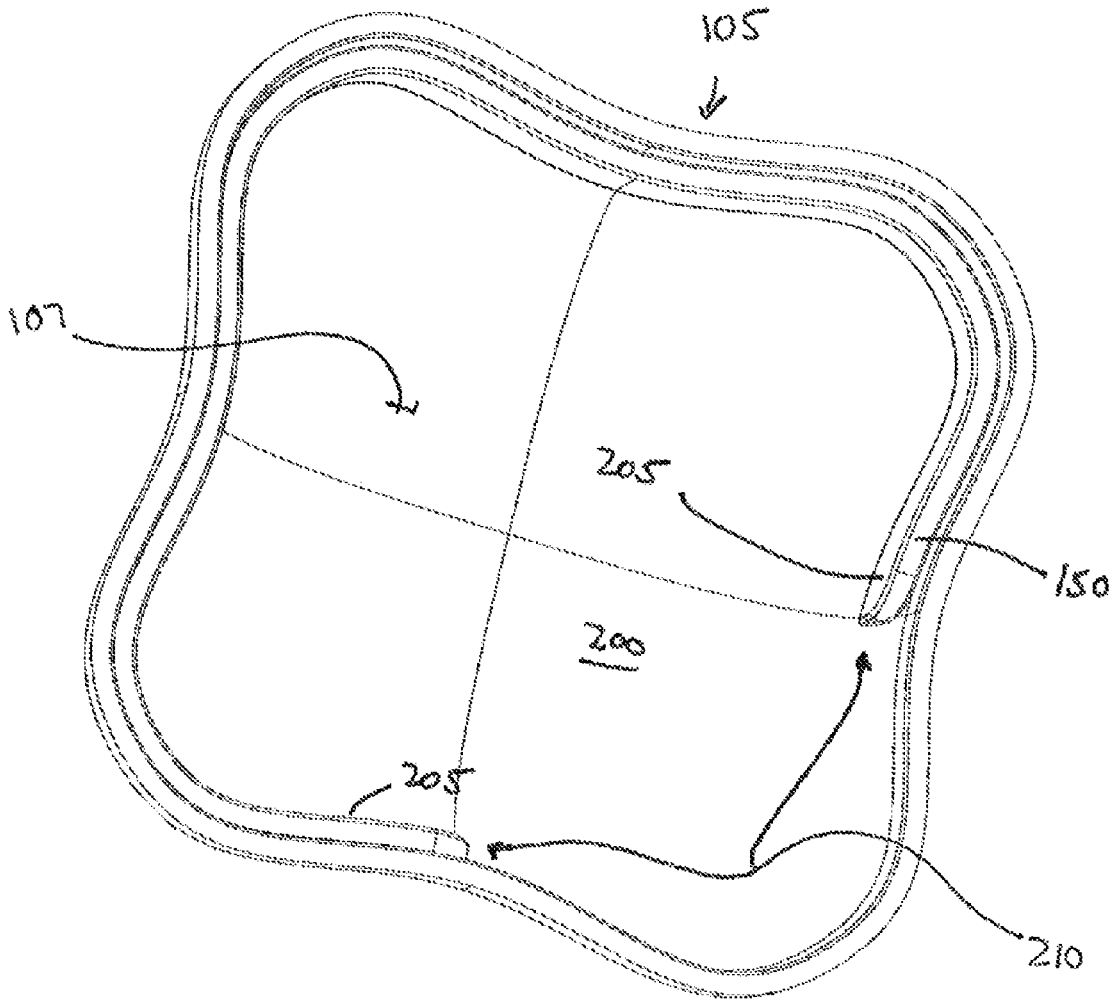
FIG. 5 is a perspective view of the bottom shell from the container in FIG. 1.

As shown in FIGS. 3 and 4, the top cover 110 is separated and displayed to expose its internal configuration as it would appear in the closed and open configuration, respectively, Referring not to FIG. 5 there is shown the bottom shell 105. The bottom shell 105 includes an interior holding region 140 defined therein. The bottom shell includes an interior surface 200 with an inside interior ledge 205 extending from the bottom shell and positioned adjacent the interior surface 200 and which creates an inside interior surface edge 150 around a portion of the bottom shell 105. The interior holding region 107 is defined within the inside interior ledge 205. Furthermore, the inside interior ledge 205 does not extend internally around the bottom shell 105 and thus leaves a gap 210 in the interior surface edge 150 which will aid in creating the at least one exposed corner 120.

Figure 6:
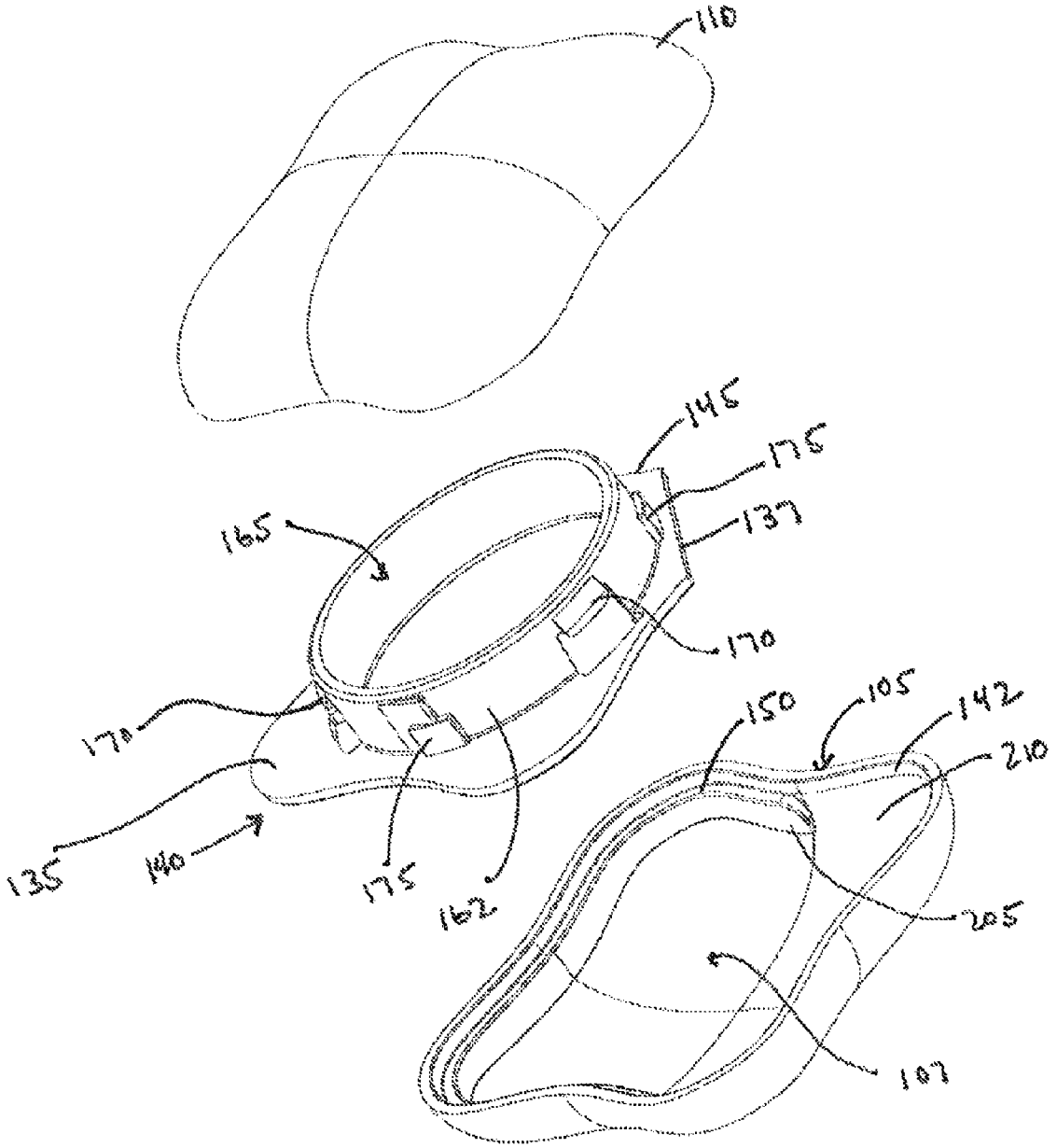
FIG. 6 is an exploded view of the container from FIG. 1.
Figure 7A:
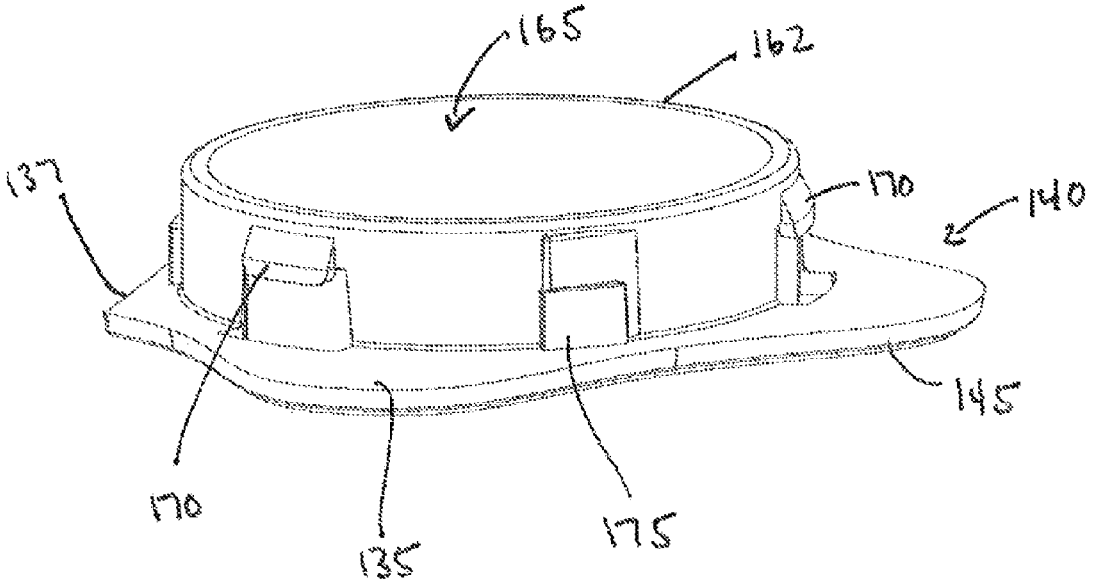
FIG. 7A is a perspective view of the intermediate connector.
Figure 7B:
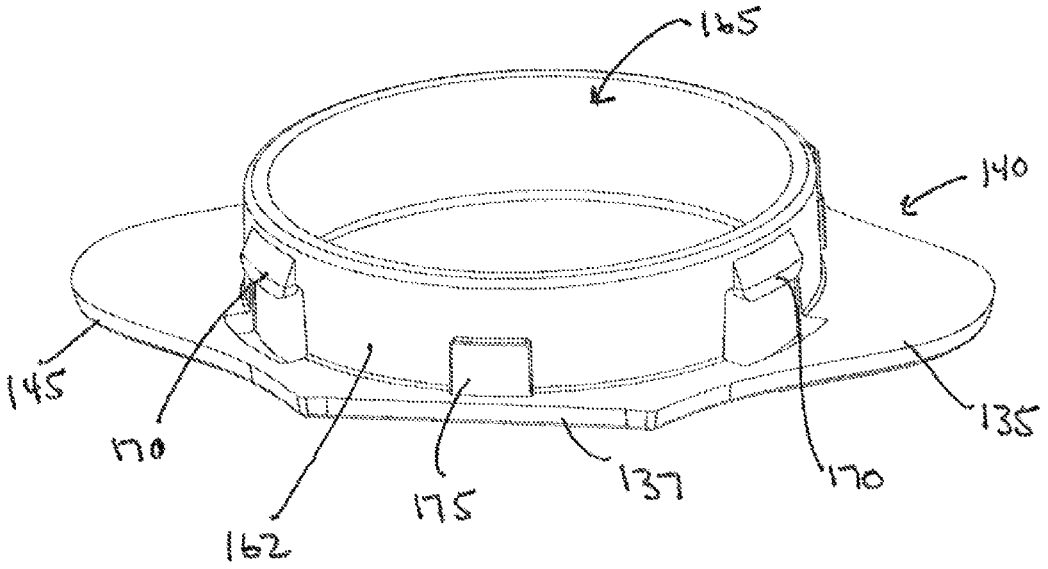
FIG. 7B is another perspective view of the intermediate connector.

Referring also to FIGS. 6, 7A and 7B, the container 100 can further be illustrated to show an intermediate connector 140. The intermediate connector 140 includes the internal plate 135 having an outer edge 145 shaped to fit against the inside interior surface edge 150 of the bottom shell 105. The internal plate 135 includes one section edge 137 that is smaller than the corresponding interior section 142 of the bottom shell 105 thereby creating the at least one exposed corner 120 when fitted together.

Extending from a center region of the internal plate 135 is an annular ring 160. The annular ring 160 includes clips 170 spaced around the exterior surface 162 of the annular ring 160 and further includes retention stops 175 interspaced between the clips 170. In addition, the annular ring 160 may be bored through the internal plate 135 to create a hollow region 165 within the annular ring 160 and which connects to the interior holding region 107 defined in the bottom shell 105.

Figure 8:
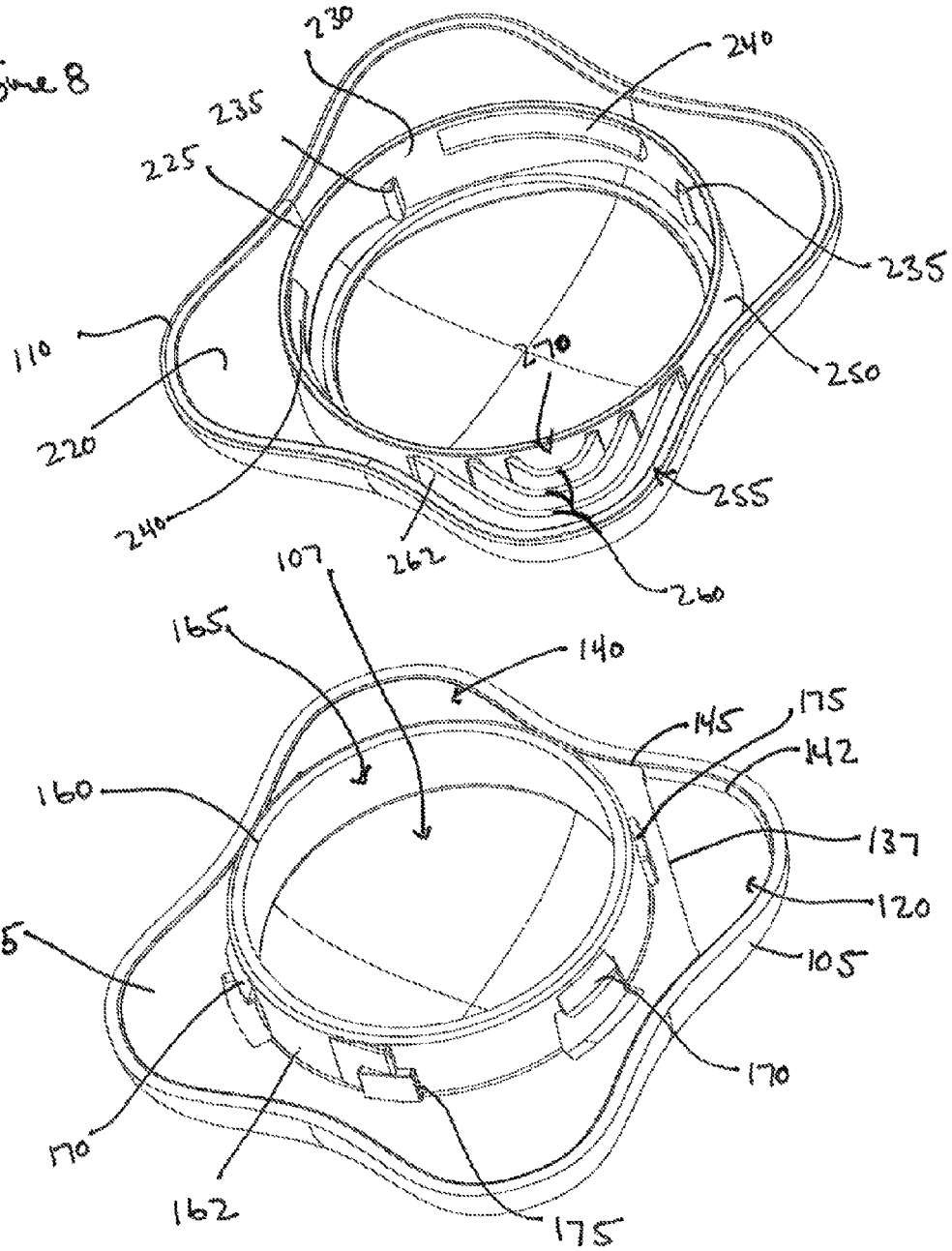
FIG. 8 is a partially exploded view illustrated the top cover exposed from the intermediate connector and bottom shell.
Figure 9A:
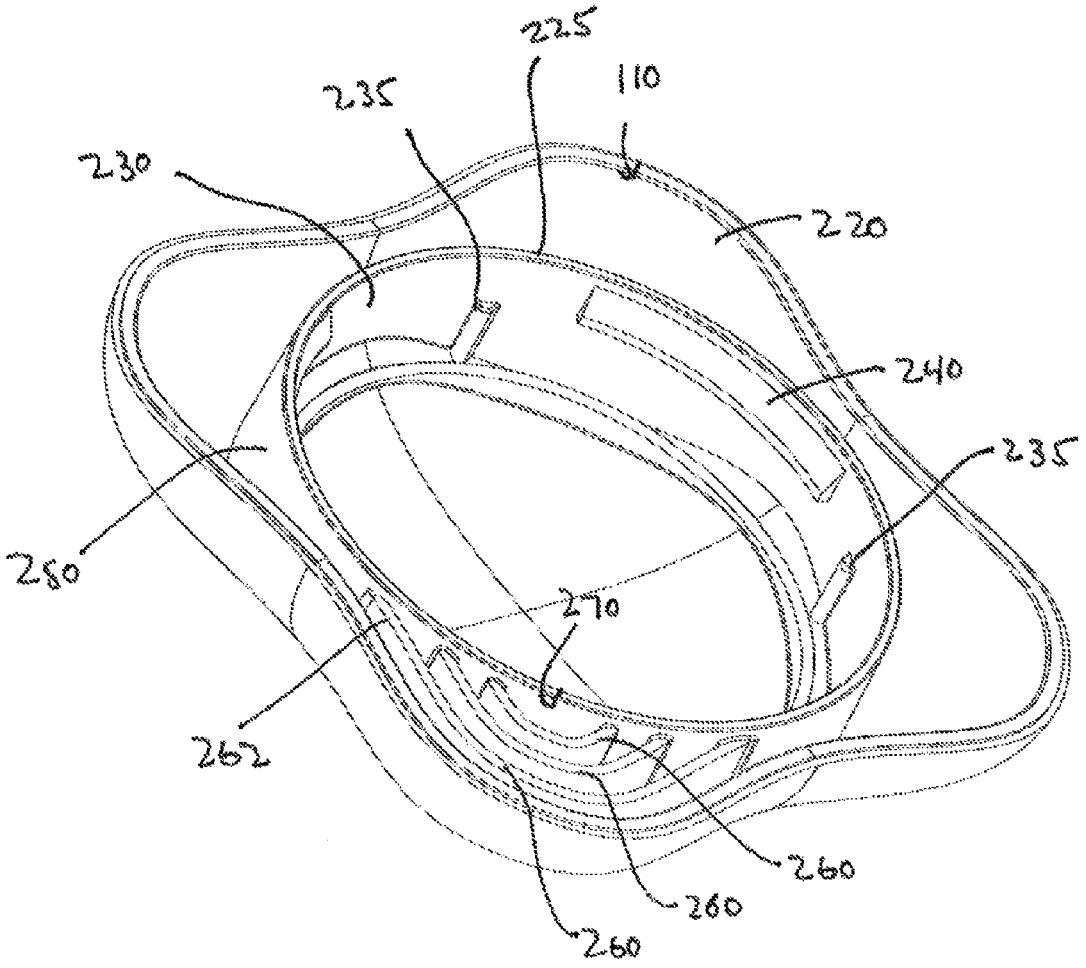
FIG. 9A is a perspective view of the top cover.
Figure 9B:
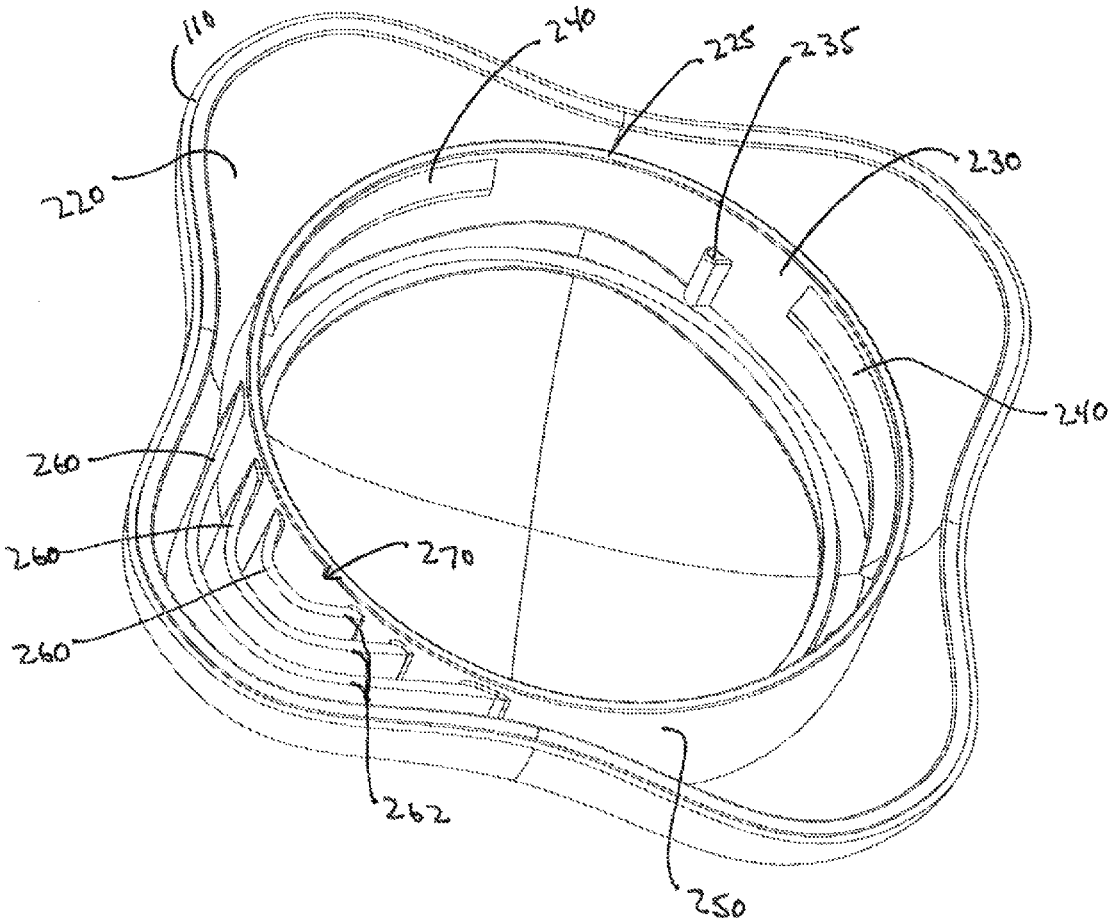
FIG. 9B is another perspective view of the top cover.

Referring now to FIGS. 8 and 9, the top cover 110 is illustrated. The top cover 110 includes a top interior surface 220 with a top annular ring 225 extending away from the top interior surface 220 and positioned to correspond to the annular ring 160 extending from the internal plate 135 on the intermediate connector 140. The top annular ring 225 is sized larger than the annular ring 160 on the intermediate connector 140 such that the top annular ring interior surface 230 fits against the intermediate annular ring exterior surface 162. Positioned within the top annular ring 160 and extending inwardly from the top annular ring interior surface 230 is stop flanges 235 vertically orientated and interspaced elongated flanges 240 horizontally oriented. When the top annular ring is fitted to the intermediate annular ring, the elongated flanges 240 sit below the clips 170 and the stop flanges 235 coact with the retention stops 175 to limit rotation of the top cover with respect to the bottom shell. In addition, extending from an exterior surface 250 of the top annular ring 225 about one section 255 of the top cover 110 are a plurality of ribs 260. The ribs 260 extend in a plurality of segments 262 one larger than the other to create a screen 270 about the exposed corner 120 when the container is in the closed configuration. When in the closed configuration the screen 270 prevents the items from leaving the interior holding region 107.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A container comprising:

a bottom shell having a base with a surrounding upstanding bottom side wail to create an interior holding region therebetween, the bottom shell having an inside interior surface edge positioned adjacent the upstanding bottom side wall, the interior surface edge having a gap positioned about at least one corner of the bottom shell;

an intermediate connector having a plate with an outer edge shaped to fit against the upstanding bottom wall and on top of the interior surface edge, the plate being configured to cover the interior holding region, the plate having a portion of the outer edge removed therefrom such that when the intermediate connector is positioned on top of the interior surface edge the removed portion overlaps the gap in the at least one corner of the bottom shell therein to define at least one exposed corner of the bottom shell and to provide access to the interior holding region, the intermediate connector further having an intermediate annular ring extend from the plate, the intermediate annular ring having an exterior surface, and further having retention stops and clips spaced around the exterior surface; and a top cover having a top interior surface with a surrounding top side wall extending downwardly such that when the top cover and bottom shell are assembled together the top side wall and bottom side wail fit together to seal contents within the container in a closed configuration, the top cover further having a top annular ring extending from the top interior surface and sized to receive there-within the intermediate annular ring, the top annular ring having interspaced stop flanges and elongated flanges, the stop flanges and elongated flanges are positioned to coact with the retention stops and caps of the intermediate annular ring to connect the top cover to the intermediate connecter and further configured to permit rotation of the top cover with respect to the bottom shell such that the top cover when rotated to an open configuration the at least one exposed corner of the bottom shell is open to permit dispensing of contents within the interior holding region, and wherein the top cover further includes a plurality of ribs extending from an exterior surface of the top annular ring and positioned about one corner of the top interior surface such that when the container is in the closed configuration, the plurality of ribs are configured to screen over the at least one corner of the bottom shell to prevent contents from leaving the interior holding region and into the top interior surface, and when the container is in the open configuration the plurality of ribs rotate with the top cover to open the at least one exposed corner of the bottom shell to permit dispensing of contents within the interior holding region.

2. The container of claim 1, wherein the intermediate annular ring being bored through the plate to provide a hollow region within the intermediate annular ring and which connects to the interior holding region defined in the bottom shell.

3. The container of claim 1, wherein the elongated flanges are horizontally oriented and positioned under the clips.

4. The container of claim 1, wherein the stop flanges are vertically oriented and positioned adjacent the retention stops when in either the open or closed configuration to limit rotation.

5. The container of claim 1, wherein the bottom shell further has an interior ledge extending about a portion of the bottom side wall and wherein the interior ledge includes the inside interior surface edge positioned adjacent the bottom side wall.

6. A container comprising:

a bottom shell having a base with a surrounding upstanding bottom side wall to create an interior holding region therebetween, the bottom shell having an inside interior surface edge positioned adjacent the upstanding bottom side wall, the interior surface edge having a gap positioned about at least one corner of the bottom shell;

an intermediate connector having a plate with an outer edge shaped to fit against the upstanding bottom side wall and against the interior surface edge, the plate being configured to cover the interior holding region, the plate having a portion of the outer edge removed therefrom such that when the intermediate connector is positioned on top of the interior surface edge the removed portion overlaps the gap in the at least one corner of the bottom shell therein to define at least one exposed corner of the bottom shell and to provide access to the interior holding region, the intermediate connector further having an intermediate annular ring extend from the plate, the intermediate annular ring having an exterior surface, and further having retention stops and clips spaced around the exterior surface;

a top cover having a top interior surface with a surrounding top side wall extending downwardly such that when the top cover and bottom shell are assembled together the top side wall and bottom side wall fit together to seal contents within the container in a closed configuration, the top cover further having a top annular ring extending from the top interior surface and sized to receive there-within the intermediate annular ring, the top a annular ring having interspaced stop flanges and elongated flanges, the stop flanges and elongated flanges are positioned to coact with the retention stops and clips of the intermediate annular ring to connect the top cover to the intermediate connecter and further configured to permit rotation of the top cover with respect to the bottom shell such that the top cover when rotated to an open configuration the at least one exposed corner of the bottom shell is open to permit dispensing of contents within the interior holding region; and a plurality of ribs extending from an exterior surface of the top annular ring and positioned about the at least one corner of the bottom shell when assembled and in the closed configuration, wherein the plurality of ribs are configured to screen over the at least one corner of the bottom shell to prevent contents from leaving the interior holding region when in the closed configuration.

7. The container of claim 6, wherein the intermediate annular ring being bored through the plate to provide a hollow region within the intermediate annular ring and which connects to the interior holding region defined in the bottom shell.

8. The container of claim 6, wherein the elongated flanges are horizontally oriented and positioned under the clips.

9. The container of claim 6, wherein the stop flanges are vertically oriented and positioned adjacent the retention stops when in either the open or dosed configuration to limit rotation.

10. The container of claim 6, wherein the bottom shell further has an interior ledge extending about a portion of the bottom side wall and wherein the interior ledge includes the inside interior surface edge positioned adjacent the bottom side wall.

11. A container comprising:

a bottom shell having a base with a surrounding bottom side wall to create an interior holding region therebetween, the bottom shell having an inside interior surface edge positioned adjacent the bottom side wall, the interior surface edge having a gap positioned about at least one corner of the bottom shell, wherein the bottom shell further has an interior ledge extending about a portion of the bottom side wall and wherein the interior ledge includes the inside interior surface edge positioned adjacent the bottom side wall;

an intermediate connector having a plate with an outer edge shaped to fit against the upstanding wall and against the interior surface edge, the plate being configured to cover the interior holding region, the plate having a portion of the outer edge removed therefrom such that when the intermediate connector is positioned on top of the interior surface edge the removed portion overlaps the gap in the at least one corner of the bottom shell therein to define at least one exposed corner of the bottom shell and to provide access to the interior holding region, the intermediate connector further having an intermediate annular ring extend from the plate, the intermediate annular ring having an exterior surface, and further having retention stops and clips spaced around the exterior surface; and a top cover having a top interior surface with a surrounding top side wall extending downwardly such that when the top cover and bottom shell are assembled together the top side wall and bottom side wall fit together to seal contents within the container in a closed configuration, the top cover further having a top annular ring extending from the top interior surface and sized to receive there-within the intermediate annular ring, the top annular ring having interspaced stop flanges and elongated flanges, the stop flanges and elongated flanges are positioned to coact with the retention stops and clips of the intermediate annular ring to connect the top cover to the intermediate connecter and further configured to permit rotation of the top cover with respect to the bottom shell such that the top cover when rotated to an open configuration the at least one exposed corner of the bottom shell is open to permit dispensing of contents within the interior holding region, and wherein the top cover further includes a plurality of ribs extending from an exterior surface of the top annular ring and positioned about one corner of the top interior surface such that when the container is in the closed configuration, the plurality of ribs are configured to screen over the at least one corner of the bottom shell to prevent contents from leaving the interior holding region and into the top interior surface, and when the container is in the open configuration the plurality of ribs rotate with the top cover to open the at least one exposed corner of the bottom shell to permit dispensing of contents within the interior holding region.

12. The container of claim 11, wherein the intermediate annular ring being bored through the plate to provide a hollow region within the intermediate annular ring and which connects to the interior holding region defined in the bottom shell.

13. The container of claim 11, wherein the elongated flanges are horizontally oriented and positioned under the clips.

14. The container of claim 11, wherein the stop flanges are vertically oriented and positioned adjacent the retention stops when in either the open or closed configuration to limit rotation.

* * * * *